US005888320A

United States Patent [19]

Dorward

[11] Patent Number: 5,888,320

[45] **Date of Patent: *Mar. 30, 1999**

[54] ALUMINUM ALLOY HAVING IMPROVED DAMAGE TOLERANT CHARACTERISTICS

[75] Inventor: Ralph C. Dorward, Livermore, Calif.

[73] Assignee: Kaiser Aluminum & Chemical Corporation, Pleasanton, Calif.

[ * ] Notice: The term of this patent shall not extend beyond the expiration date of Pat. No. 5,662,750.

[21] Appl. No.: 803,718

[22] Filed: Feb. 21, 1997

Related U.S. Application Data

[63] Continuation of Ser. No. 438,784, May 11, 1995, abandoned.

[51] Int. Cl.[6] ..... C22F 1/043

[52] U.S. Cl. ..... 148/690; 148/693; 148/694; 148/417; 148/439; 420/532; 420/534; 420/541

[58] Field of Search ..... 148/415, 417, 148/439, 440, 690, 693, 694; 420/532, 534, 541

[56] References Cited

U.S. PATENT DOCUMENTS

| | | | |
|---|---|---|---|
| 4,082,578 | 4/1978 | Evancho et al. | 148/690 |
| 4,231,817 | 11/1980 | Takeuchi et al. | 148/439 |
| 4,589,932 | 5/1986 | Park | 148/690 |
| 5,662,750 | 9/1997 | Shen | 148/694 |

FOREIGN PATENT DOCUMENTS

| | | | |
|---|---|---|---|
| 53-065209 | 6/1978 | Japan . | |
| 55-8426 | 1/1980 | Japan . | |
| 60-082643 | 5/1985 | Japan . | |
| Hei 6-240424 | 2/1993 | Japan | 148/693 |
| 6-240424 | 8/1994 | Japan | 148/693 |

OTHER PUBLICATIONS

Chaudhuri, et al., "Comparison of Corrosion–Fatigue Properties of 6013 Bare, Alclad 2024, and 2024 Bare Aluminum Alloy Sheet Materials", Journal of Materials Engineering and Performance, vol. 1, Feb. 1992, pp. 91–96.

*Primary Examiner*—George Wyszomierski
*Attorney, Agent, or Firm*—Philip L. McGarrigle; Gerald D. Haynes

[57] ABSTRACT

A method of producing an aluminum product having high formability high fracture toughness, high strength and improved corrosion resistance, the method comprising: (a) providing stock including an aluminum base alloy consisting essentially of about 0.7 to 1.0 wt. % silicon, not more than about 0.3 wt. % iron, not more than about 0.5 wt. % copper, about 0.8 to 1.1 wt. % magnesium, about 0.3 to 0.4 wt. % manganese, and about 0.5 to 0.8 wt. % zinc, the remainder substantially aluminum, incidental elements and impurities; (b) homogenizing the stock at a temperature ranging from about 950° to 1050° F. for a time period ranging from about 2 to 20 hours; (c) hot rolling at a temperature ranging from about 750° to 950° F. will increase; (d) solution heat treating at a temperature ranging from about 1000° to 1080° F. for a time period ranging from about 5 minutes to one hour; (e) cooling by quenching at a rate of about 1000° F./second to a temperature of 100° F. or lower; and (f) artificially aging by reheating to a temperature ranging from about 300° to 400° F. for a time period ranging from about 2 to 20 hours to produce a T6 temper in the aluminum product.

24 Claims, 2 Drawing Sheets

ALUMINUM ALLOY HAVING IMPROVED DAMAGE TOLERANT CHARACTERISTICS

This application is a continuation, of application Ser. No. 08/438,784, filed May 11, 1995.

BACKGROUND OF THE INVENTION

1. Field of Invention

This invention relates to aluminum alloys suitable for use in aircraft, automobiles, and other applications and to improved methods of producing such alloys. More specifically, it relates to a method of making an improved aluminum product, particularly useful in aircraft applications, having improved damage tolerant characteristics, including improved corrosion resistance, formability, fracture toughness and strength properties.

2. Description of the Related Art

Workers in the field have used heat treatable aluminum alloys in a number of applications involving relatively high strengths such as aircraft fuselages, vehicular members and other applications. Aluminum alloys 6061 and 6063 are among the most popular heat treatable aluminum alloys in the United States. These alloys have useful strength and toughness properties in both T4 and T6 tempers. They lack, however, sufficient strength for most structural aerospace applications.

More recently, Alloys 6009 and 6010 have been used as vehicular panels in cars and boats. These alloys and their products are described in U.S. Pat. No. 4,082,578, issued Apr. 4, 1978 to Evancho et al. In general, alloy 6010 includes 0.8 to 1.2 wt. % Si, 0.6 to 1.0% Mg, 0.15 to 0.6 wt. % Cu, 0.2 to 0.8 wt. % Mn, balance essentially aluminum. Alloy 6009 is similar to alloy 6010 except for lower Si at 0.6 to 1.0 wt. % and lower Mg at 0.4 to 0.6 wt. %.

In spite of the usefulness of the 6009 and 6010 alloys, these alloys are generally unsuitable for the design of commercial aircraft which require different sets of properties for different types of structures. Depending on the design criteria for a particular airplane component, improvements in fracture toughness and fatigue resistance result in weight savings, which translate to fuel economy over the lifetime of the aircraft, and/or a greater level of safety.

To meet this need, workers in the field have attempted to develop alloys having improved impact and dent resistance as well as substantial toughness. For example in U.S. Pat. No. 4,589,932, issued May 20, 1986 to Park describes a 6013 alloy which includes 0.4 to 1.2 wt. % Si, 0.5 to 1.3 wt. % Mg, 0.6 to 1.1 wt. % Cu, 0.1 to 1% Mn, the balance essentially aluminum. Similarly, Japanese Patent Application Kokai No. 60-82643 describes an alloy which includes 0.4 to 1.5 wt. % Si, 0.5 to 1.5 wt. % Mg, 0.4 to 1.8 wt. % Cu, 0.05 to 1.0 wt. % Mn, 1.0 to 6.0 wt. % Zn which emphasizes adding copper to reduce intercrystalline cracks. These new generation of 6XXX alloys are characterized by relatively high copper levels which provide a strength advantage. Unfortunately, the high copper contents also produce an increased susceptibility to intergranular corrosion. Corrosion of this type causes strength degradation in service, but more importantly, greatly detracts from fatigue resistance.

Corrosion damage has been a perennial problem in today's aircraft, and the fuselage is the prime location for corrosion to occur. Improvements in corrosion resistance, therefore, are often sought with or without weight savings. Thus, the new generation of 6XXX alloys are generally unsuitable for aircraft applications because of their susceptibility to intergranular corrosion caused by high copper levels as discussed in Chaudhuri et al., Comparison of Corrosion-Fatigue Properties of 6013 Bare, Alclad 2024, and 2024 Bare Aluminum Alloy Sheet Materials, JMEPEG (1992) 1:91–96.

Another approach taken in U.S. Pat. No. 4,231,817, issued Nov. 4, 1980 to Takeuchi et al. and Japanese Patent Application Kokai Nos. 55-8426 and 53-65209 which generally describe 6061 and 6063 type alloys which have added zinc. Although the added zinc is reported to improve corrosion resistance, these alloys lack sufficient strength for most structural aerospace applications.

Turning now to formability, many aerospace alloys such as 2024 and 7075 are formed in the annealed O temper or freshly quenched W temper. Forming in the O temper requires, however, a subsequent solution heat treatment operation, which usually introduces distortion problems. Forming in the W temper alleviates the distortion concern, but sheet in this condition hardens as it naturally ages, so either the delay time between solution heat treating and forming must be minimized, or the material must be stored in a freezer until it is ready to be formed. In contrast, a sheet material that has good formability in the stable T4 condition circumvents all of these potential problems because the manufacturer need only age to the T6 temper after making the part. It is therefore desirable for the aerospace alloy to have good formability in the stable T4 condition.

In sum, a need remains for an alloy having improved resistance to corrosion and yet maintains the desirable strength, toughness, and T4 formability properties exhibited by the 6013 type alloys. Accordingly, it is an object of this invention to provide such an alloy.

SUMMARY OF THE INVENTION

The present invention provides a method of producing an aluminum product comprising: providing stock including an aluminum base alloy consisting essentially of about 0.6 to 1.4 wt. % silicon, not more than about 0.5 wt. % iron, not more than about 0.6 wt. % copper, about 0.6 to 1.4 wt. % magnesium, about 0.4 to 1.4 wt. % zinc, at least one element selected from the group consisting of about 0.2 to 0.8 wt. % manganese and about 0.05 to 0.3 wt. % chromium, the remainder substantially aluminum, incidental elements and impurities; homogenizing the stock; hot working, solution heat treating; and quenching. The product can then either be naturally aged to produce an improved alloy having good formability in the T4 temper or artificially aged to produce an improved alloy having high strength and fracture toughness, along with improved corrosion resistance properties.

The foregoing and other objects, features, and advantages of the invention will become more readily apparent from the following detailed description of preferred embodiment which proceeds with reference to the drawings.

DETAILED DESCRIPTION OF THE INVENTION

The high formability, high fracture toughness, high strength, and enhanced corrosion resistance properties of the alloy of the present invention are dependent upon a chemical composition that is closely controlled within specific limits as set forth below and upon a carefully controlled heat treatment. If the composition limits, fabrication, and heat-treatment procedures required to produce the invention alloy stray from the limits set forth below, the desired combination of desired formability, fracture toughness, strength and corrosion resistance properties will not be achieved.

The aluminum alloy of the present invention consists essentially of about 0.6 to 1.4 wt. % silicon, not more than about 0.5 wt. % iron, not more than about 0.6 wt. % copper, about 0.6 to 1.4 wt. % magnesium, about 0.4 to 1.4 wt. % zinc, at least one element selected from the group consisting of about 0.2 to 0.8 wt. % manganese and about 0.5 to 0.3 wt. % chromium, the remainder substantially aluminum, incidental elements, and impurities.

The preferred range of silicon is about 0.7 to 1.0 wt. %. At least about 0.6 wt. % is needed to provide sufficient strength while amounts in excess of 1.2 wt. % tend to produce an alloy that is brittle in the T6 temper. Iron can be present up to about 0.5 wt. % and preferably below about 0.3 wt. %. Higher levels of iron tend to produce an alloy having lower toughness. The preferred range of magnesium is about 0.8 to 1.1 wt. %. At least about 0.6 wt. % magnesium is needed to provide sufficient strength while amounts in excess of about 1.2 wt. % make it difficult to dissolve enough solute to obtain sufficient age hardening precipitate to provide high T6 strength.

Figure 1:
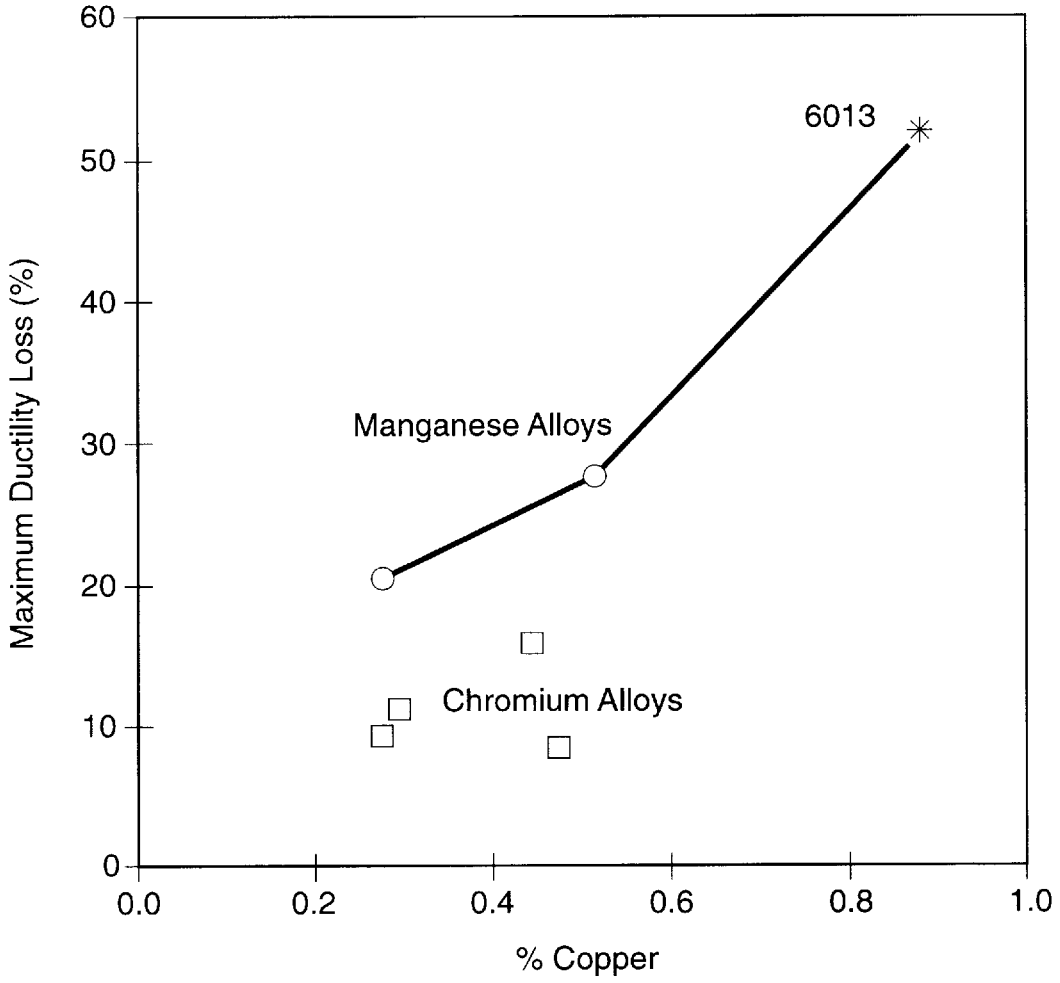
FIG. 1 is a graph showing ductility loss as a function of the amount of copper in alloys containing either manganese or chromium and zinc relative to alloy 6013.

I have found that I can produce an improved alloy sheet, suitable for aircraft fuselage skin which is particularly resistant to corrosion but still maintains high strength, high fracture toughness, and good formability. I do this by talking a 6013 type alloy and greatly reducing its copper content while also adding significant amounts of zinc. In my improved product, if copper exceeds 0.6 wt. %, the products become more prone to corrosion problems. I prefer to keep copper levels below about 0.5 wt. %. For example, as shown in FIG. 1, by increasing copper from 0.5 wt. % to 0.9 wt. %, general corrosion damage (measured by ductility loss) will increase by as much as 50%. Some copper below these limits, however, is desirable to improve strength while not greatly adversely affecting corrosion resistance.

Figure 2:
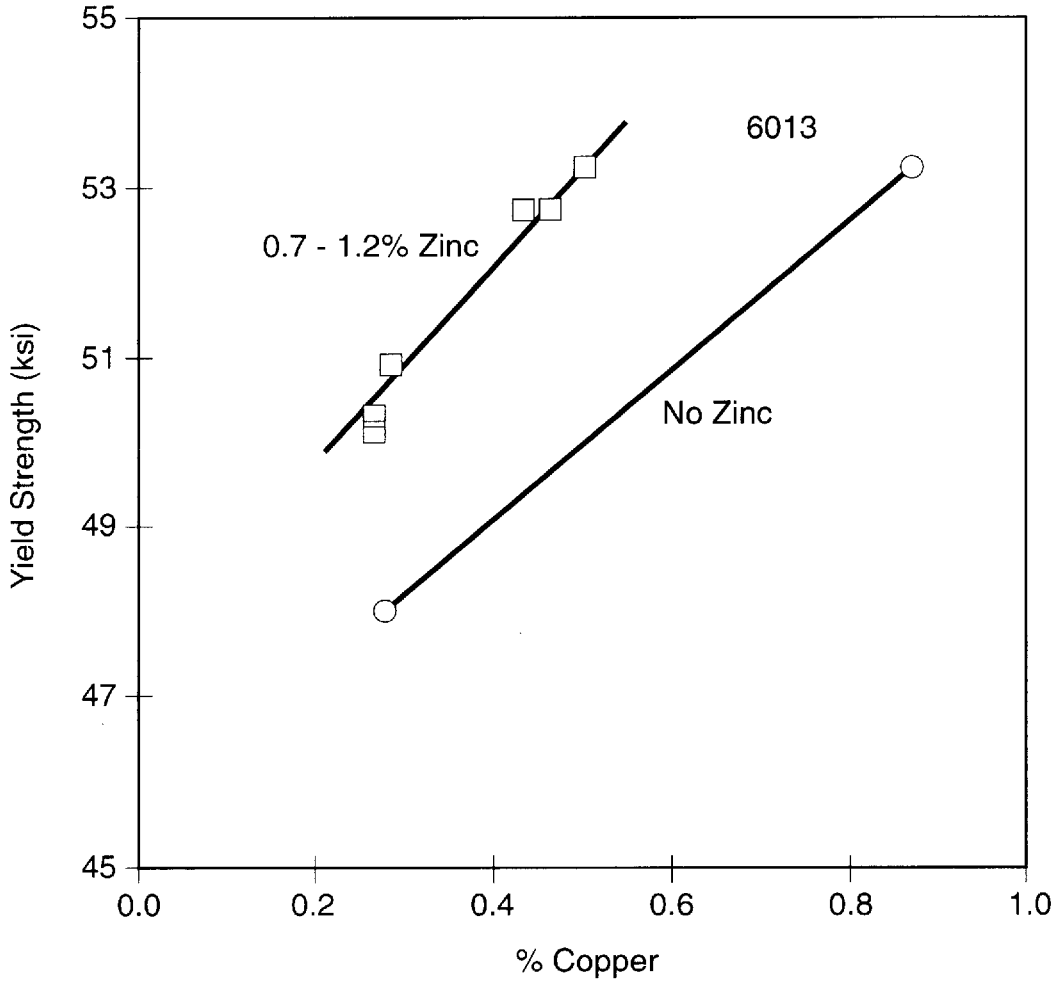
FIG. 2 is a graph showing the effect of copper and zinc on the strength of alloys containing either manganese or chromium.

Reducing the amount of copper in the new alloy has the disadvantage of reducing strength as shown in FIG. 2. Unexpectedly, I have discovered that I can compensate for the loss of copper by adding from about 0.4 to 1.4 wt. % zinc and preferably about 0.5 to 0.8 wt. % zinc. Surprisingly, the added zinc provides sufficient strength to the new alloy while not producing any adverse corrosion resistance, toughness or formability effects. By adding zinc in amounts below 0.4 wt. %, I do not obtain sufficient strength for highly specialized aircraft applications, such as fuselage skin, while adding zinc in amounts in excess of 1.4 wt. % tends to produce an alloy having undesirable higher density.

To produce the improved aluminum product, I first homogenize the alloy stock to produce a substantially uniform distribution of alloying elements. In general, I homogenize by heating the stock to a temperature raging from about 950° to 1050° F. for a time period ranging from about 2 to 20 hours to dissolve soluble elements and to homogenize the internal structure of the metal. I caution, however, that temperatures above 1060° F. are likely to damage the metal and thus I avoid these increased temperatures if possible. Generally, I homogenize for at least 10 hours in the homogenization temperature range. Most preferably, I homogenize for about 8 to 16 hours at a temperature of about 1030° F.

Next, I hot work the stock. Depending on the type of product I wish to produce, I either hot roll, extrude, forge or use some other similar hot working step. For example, I may extrude at a temperature ranging from about 800° to 950° F. My new alloy is well suited for making high quality sheet suitable for aircraft skin so my preferred hot working step is to hot roll. To hot roll, I heat the stock to a temperature ranging from about 750° to 950° F. for a time period ranging from about 2 to 10 hours. I generally perform hot rolling at a starting temperature ranging from about 750° to 900° F., or even higher as long as no melting or other ingot damage occurs. When the alloy is to be used for fuselage skins, for example, I typically perform hot rolling on ingot or starting stock 15 to 20 or more inches thick to provide an intermediate product having a thickness ranging from about 0.15 to 0.30 inches.

Depending on the type of sheet that I am producing, I may additionally cold roll after hot rolling to further reduce sheet thickness. Preferably, I allow the sheet to cool to less than 100° F. and most preferably to room temperature before I begin cold rolling. Preferably, I cold roll to obtain at least a 40% reduction in sheet thickness, most preferably I cold roll to a thickness ranging from about 50 to 70% of the hot rolled gauge.

After cold rolling (or after hot rolling if I do not cold roll), I next solution heat treat the sheet. Preferably, I solution heat treat at a temperature ranging from about 1000° to 1080° F. for a time period ranging from about 5 minutes to one hour. It is important to rapidly heat the stock, preferably at a heating rate of about 100° to 2000° F. per minute. Most preferably, I solution heat treat at about 1020° to 1050° F. for about 10 to 20 minutes using a heating rate of about 1000° F. per minute.

If the solution heat treat temperature is substantially below 1020° F., then the soluble elements, silicon, copper and magnesium are not taken into solid solution, which can have two undesirable consequences: (1) there is insufficient solute to provide adequate strength upon subsequent age hardening; and (2) the silicon, copper and magnesium-containing intermetallic compounds that remain undissolved detract from fracture toughness, fatigue resistance, and corrosion resistance. Similarly, if the time at the solution heat treatment temperature is too short, these intermetallic compounds do not have time to dissolve. The heating rate to the solutionizing temperature is important because relatively fast rates generate a fine grain (crystallite) size, which is desirable for good fracture toughness and high strength.

After solution heat treatment, I rapidly cool the stock to minimize uncontrolled precipitation of secondary phases, such as $Mg_2Si$. Preferably, I quench at a rate of about 1000° F./sec. over the temperature range 750° to 550° F. from the solution temperature to a temperature of 100° F. or lower. Most preferably, I quench using a high pressure water spray at room temperature or by immersion into a water bath at room temperature, generally ranging from about 60° to 80° F.

At this point I can either obtain a T4 temper by allowing the product to naturally age or I can obtain a T6 temper by artificial aging. To artificial age, I prefer to reheat the product to a temperature ranging from about 300° to 400° F. for a time ranging from about 2 to 20 hours

EXAMPLE 1

To demonstrate the present invention, I first prepared alloys of the compositions shown in Table 1 as DC (direct chill) cast ingots, which I then homogenized at 1025° F. for 12 hours, cooled to room temperature, reheated to 900° F., hot rolled to 0.160 in. and cold rolled to 0.060 in. I then solution heat treated a portion of each sheet for 20 minutes at 1040° F., quenched in 70° F. water and aged at 375° F. hours (T6 temper).

TABLE 1

Chemical Compositions of Alloys Containing Manganese

| | % by Wt. | | | | | | | |
|---|---|---|---|---|---|---|---|---|
| Alloy No. | Si | Fe | Cu | Mn | Mg | Cr | Zn | Ti |
| 1 | 0.76 | 0.17 | 0.28 | 0.43 | 0.94 | <0.01 | 0.02 | 0.05 |
| 2 | 0.79 | 0.14 | 0.27 | 0.37 | 0.95 | <0.01 | 1.15 | 0.02 |
| 3 | 0.77 | 0.14 | 0.51 | 0.37 | 0.93 | <0.01 | 1.14 | 0.05 |
| 4 (6013) | 0.75 | 0.17 | 0.88 | 0.42 | 0.95 | <0.01 | 0.05 | 0.08 |

I tested the artificially aged T6 temper materials tested for transverse tensile properties before and after a 30-day corrosive exposure to a 3½% NaCl solution (alternate immersion as described in ASTM G-44). As recommended in the Corrosion Handbook (edited by H. H. Uhlig, John Wiley & Sons, p. 956), I quantified corrosion damage by loss in ductility. This method is particularly suited to materials that are susceptible to pitting and intergranular corrosion. I also tested the materials for Kahn tear properties (unit propagation energy and tear strength—yield strength ratio), which are known to correlate with fracture toughness.

Next, I evaluated the naturally aged (T4 temper) sheets for formability under conditions of: (1) uniaxial stretching as measured by elongation in a standard tensile test, (2) biaxial stretching as measured by indenting the sheet with a 1-in. diameter steel ball (also known as Olsen cup depth), and (3) near-plane strain deformation as measured by stretching a narrow strip with a 2-in. diameter steel ball.

Table 2 shows the results of the tensile tests on the as-processed T6 temper materials.

TABLE 2

Transverse Tensile Properties of T6 Temper Sheets Containing Manganese

| Alloy No. | % Cu | % Zn | Ultimate Tensile Strength, psi | Yield Strength, psi | Elongation, % in 2-in. |
|---|---|---|---|---|---|
| 1 | 0.28 | 0.02 | 50.5 | 48.0 | 8.4 |
| 2 | 0.27 | 1.15 | 52.6 | 50.3 | 7.8 |
| 3 | 0.51 | 1.14 | 56.5 | 53.2 | 9.0 |
| 4 (6013) | 0.88 | 0.05 | 58.5 | 53.2 | 9.6 |

The data show that an alloy with about 0.50% copper and about 1.15% zinc has an equivalent yield strength to that of alloy 6013. It is also evident that the addition of about 1.15% zinc to a base alloy containing about 0.25% copper increased its strength by about 2–2.5 ksi.

Table 3 gives the results of the tensile tests conducted on the corroded T6 temper sheets.

TABLE 3

Tensile Ductility of Post corroded or Precorroded[a] T6 Temper Sheets Containing Manganese

| | | | % Elongation[b] | | % Ductility Loss | |
|---|---|---|---|---|---|---|
| Alloy No. | % Cu | % Zn | Ave. | Min. | Ave. | Max. |
| 1 | 0.28 | 0.02 | 8.1 | 8.0 | 3.6 | 4.8 |
| 2 | 0.27 | 1.15 | 6.7 | 6.2 | 14.1 | 20.5 |
| 3 | 0.51 | 1.14 | 7.7 | 6.5 | 14.4 | 27.8 |
| 4 (6013) | 0.88 | 0.05 | 6.1 | 4.6 | 36.5 | 52.1 |

[a]30-day alternate immersion exposure to 3½% NaCl solution.
[b]Triplicate specimens.

The alloys containing about 0.25% to 0.5% copper and 1.15% zinc had much better corrosion resistance than 6013 alloy with 0.88% copper.

Table 4 gives the Kahn tear properties for the T6 temper sheets which I used to characterize the fracture toughness of the materials.

TABLE 4

Kahn Tear Properties of T6 Temper Sheets Containing Manganese

| Alloy No. | % Cu | % Zn | Unit Prop'n Energy (in-lb/in$^2$) | Tear Strength Yield Strength Ratio |
|---|---|---|---|---|
| 1 | 0.28 | 0.02 | 985 | 1.59 |
| 2 | 0.27 | 1.15 | 821 | 1.49 |
| 3 | 0.51 | 1.14 | 864 | 1.52 |
| 4 (6013) | 0.88 | 0.05 | 833 | 1.53 |

These data show that the alloys with about 0.25% to 0.5% copper and 1.15% zinc have about equal toughness to alloy 6013.

Table 5 gives the results of the formability tests on the T4 temper materials.

TABLE 5

Formability of T4 Temper Sheets Containing Manganese

| Alloy No. | % Cu | % Zn | Longitudinal Elongation, % | Longitudinal Punch Depth, in. | Olsen Cup Depth, in. |
|---|---|---|---|---|---|
| 1 | 0.28 | 0.02 | 26.9 | 0.670 | 0.345 |
| 2 | 0.27 | 1.15 | 27.1 | 0.690 | 0.340 |
| 3 | 0.51 | 1.14 | 28.4 | 0.710 | 0.344 |
| 4 (6013) | 0.88 | 0.05 | 28.9 | 0.680 | 0.347 |

The formability of the alloys with about 0.25% to 0.5% copper and 1.15% zinc were generally superior to the 0.28% copper base alloy and approximately equal to alloy 6013.

The foregoing results show that alloys with about 0.25% to 0.5% copper and 1.15% have comparable strength, toughness and formability to alloy 6013, but have significantly improved corrosion resistance.

EXAMPLE 2

To demonstrate an alternative embodiment of my invention, I prepared alloys of the compositions shown in Table 6 in a similar manner to those in Example 1 except that they all contained about 0.15% chromium instead of manganese.

TABLE 6

Chemical Compositions of Alloys Containing Chromium

| Alloy No. | Si | Fe | Cu | Mn | Mg | Cr | Zn | Ti |
|---|---|---|---|---|---|---|---|---|
| | % by Wt. | | | | | | | |
| 5 | 0.77 | 0.16 | 0.29 | <0.01 | 0.93 | 0.15 | 0.73 | 0.05 |
| 6 | 0.74 | 0.14 | 0.27 | <0.01 | 0.89 | 0.15 | 1.08 | 0.05 |
| 8 | 0.73 | 0.16 | 0.47 | <0.01 | 0.91 | 0.14 | 1.03 | 0.03 |
| 7 | 0.75 | 0.17 | 0.44 | <0.01 | 0.94 | 0.15 | 0.72 | 0.02 |

Next, I evaluated the alloys for formability (T4 temper), tensile properties, corrosion resistance and toughness by the same procedures that I used in Example 1. Table 7 the tensile properties for the T6 temper for these alloys.

TABLE 7

Transverse Tensile Properties of T6 Temper Sheets Containing Chromium

| Alloy No. | % Cu | % Zn | UTS (psi) | YS (psi) | % Elongation |
|---|---|---|---|---|---|
| 5 | 0.29 | 0.73 | 52.6 | 50.9 | 7.2 |
| 6 | 0.27 | 1.08 | 52.1 | 50.1 | 7.5 |
| 7 | 0.44 | 0.72 | 55.0 | 52.7 | 8.3 |
| 8 | 0.47 | 1.03 | 55.3 | 52.7 | 8.3 |

Allowing for the fact that alloys 6 and 8 had lower magnesium and silicon contents than the corresponding manganese-containing alloys 2 and 3 (Table 2), these materials had essentially equivalent strengths. It is apparent that a zinc concentration of about 0.7 wt. % is almost as effective as 1.1 wt. % level. This is important because the zinc concentration should be kept at its lowest possible level necessary to provide a strength advantage since higher concentrations increase the density of the alloy, which is undesirable for aerospace applications.

Table 8 gives the results of the tensile tests conducted on the corroded T6 temper sheets.

TABLE 8

Tensile Ductility of Post corroded[a] or Pre corroded T6 Temper Sheets Containing Chromium

| Alloy No. | % Cu | % Zn | % Elongation[b] Ave. | % Elongation[b] Min. | % Ductility Loss Ave. | % Ductility Loss Max. |
|---|---|---|---|---|---|---|
| 5 | 0.29 | 0.73 | 6.9 | 6.4 | 4.2 | 11.1 |
| 6 | 0.27 | 1.08 | 7.1 | 6.8 | 5.3 | 9.3 |
| 7 | 0.44 | 0.72 | 7.2 | 7.0 | 13.3 | 15.7 |
| 8 | 0.47 | 1.03 | 8.1 | 7.6 | 2.4 | 8.4 |

[a]30-day alternate immersion exposure to 3½% NaCl solution.
[b]Triplicate specimens.

Comparison of these results with those in Table 3 shows that the chromium-containing alloys have significantly superior corrosion resistance to the manganese-containing alloys.

Table 9 gives the Kahn tear (toughness) properties of the T6 temper sheets.

TABLE 9

Kahn Tear Properties of T6 Temper Sheets Containing Chromium

| Alloy No. | % Cu | % Zn | Unit Prop'n Energy (in-lb/in$^2$) | Tear Strength-Yield Strength Ratio |
|---|---|---|---|---|
| 5 | 0.29 | 0.73 | 572 | 1.39 |
| 6 | 0.27 | 1.08 | 613 | 1.44 |
| 7 | 0.44 | 0.72 | 630 | 1.44 |
| 8 | 0.47 | 1.03 | 675 | 1.42 |

By comparison with Table 4, it is apparent that the chromium-containing alloys have lower fracture toughness than the manganese-containing materials.

Table 10 lists the results of the formability tests on the T4 temper materials.

TABLE 10

Formability of T4 Temper Sheets Containing Chromium

| Alloy No. | % Cu | % Zn | Longitudinal Elongation (%) | Longitudinal Punch Depth (in.) | Olsen Cup Depth (in.) |
|---|---|---|---|---|---|
| 5 | 0.29 | 0.73 | 29.1 | 0.723 | 0.336 |
| 6 | 0.27 | 1.08 | 29.1 | 0.722 | 0.321 |
| 7 | 0.44 | 0.72 | 29.6 | 0.708 | 0.324 |
| 8 | 0.47 | 1.03 | 29.6 | 0.704 | 0.327 |

By comparison with Table 5, it is evident that the chromium-containing alloys have better longitudinal stretching capability than 6013 and the other manganese-containing alloys. Longitudinal punch depths (plane strain stretching) are about the same, whereas Olsen cup depths (biaxial stretching) are slightly lower.

Surprisingly, the Al-Mg-Si-Cu alloys in which I partially replaced the copper with zinc had much improved corrosion resistance while maintaining strength levels comparable to the 6013 type alloys. FIGS. 1 and 2 illustrate these results. Specifically, FIGS. 1 and 2 compare the corrosion resistance and strengths of such alloys with the relatively high copper alloy 6013. The invention alloys, which comprise manganese as the grain structure control agent, also have equivalent toughness and formability characteristics. The invention alloys, which contain chromium as the grain structure control agent, have even further enhanced corrosion resistance with better uniaxial stretching capability in the T4 temper.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method of producing an aluminum product comprising:

(a) providing stock including an aluminum base alloy consisting essentially of about 0.6 to 1.4 wt. % silicon, not more than about 0.5 wt. % iron, not more than about 0.6 wt. % copper, about 0.6 to 1.4 wt. % magnesium, about 0.4 to 1.4 wt. % zinc, at least one element selected from the group consisting of about 0.2 to 0.8 wt. % manganese and about 0.05 to 0.3 wt. % chromium, the remainder substantially aluminum, incidental elements and impurities;

(b) homogenizing the stock;

(c) hot working the stock, (d) solution heat treating the stock; and (e) quenching the stock;

wherein the stock has a ductility loss at least 5% less than a comparably treated alloy comprising approximately 0.88 wt % Cu, 0.05 wt % Zn, 0.75 wt % Si, 0.17 wt % Fe, 0.42 wt % Mn, 0.95 wt % Mg, 0.08 wt % Ti and <0.01 wt % Cr.

2. The method of claim 1 wherein the alloy of step (a) comprises about 0.7 to 1.0 wt. % silicon, not more than about 0.3 wt. % iron, not more than 0.5 wt. % copper, about 0.8 to 1.1 wt. % magnesium, and about 0.5 to 0.8 wt. % zinc.

3. The method of claim 2 wherein the alloy comprises about 0.3 to 0.4 wt. % manganese.

4. The method of claim 2 wherein the alloy comprises about 0.1 to 0.2 wt. % chromium.

5. The method of claim 1 wherein step (c) is selected from the group consisting of hot rolling at a temperature ranging from about 750° to 950° F., extruding at a temperature ranging from about 800° to 950° F., and forging.

6. The method of claim 1 further comprising natural aging to produce an improved alloy having good formability in a naturally aged T4 temper.

7. The method of claim 1 further comprising artificially aging to produce an improved alloy having good strength, toughness, and corrosion resistance properties.

8. A product prepared by a process comprising the steps of:

(a) providing stock including an aluminum base alloy consisting essentially of about 0.6 to 1.4 wt. % silicon, not more than about 0.5 wt. % iron, not more than about 0.6 wt. % copper, about 0.6 to 1.2 wt. % magnesium, about 0.4 to 1.4 wt. % zinc, at least one element selected from the group consisting of about 0.2 to 0.8 wt. % manganese and about 0.05 to 0.3 wt. % chromium, the remainder substantially aluminum, incidental elements and impurities;

(b) homogenizing the stock;

(c) hot working the stock, (d) solution heat treating the stock; and (e) quenching the stock;

wherein the stock has a ductility loss at least 5% less than a comparably treated alloy comprising approximately 0.88 wt % Cu, 0.05 wt % Zn, 0.75 wt % Si, 0.17 wt % Fe, 0.42 wt % Mn, 0.95 wt % Mg, 0.08 wt % Ti and <0.01 wt % Cr.

9. The product of claim 8 wherein the alloy of step (a) comprises about 0.7 to 1.0 wt. % silicon, not more than about 0.3 wt. % iron, about 0.3 to 0.5 wt. % copper, about 0.8 to 1.1 wt. % magnesium, and about 0.5 to 0.8 wt. % zinc.

10. The product of claim 8 wherein the alloy comprises about 0.3 to 0.4 wt. % manganese.

11. The product of claim 8 wherein the alloy comprises about 0.1 to 0.2 wt. % chromium.

12. The product of claim 8 which has been naturally aged to produce an improved alloy having good formability in a naturally aged T4 temper.

13. The product of claim 8 which has been artificially aged to produce an improved alloy having good strength, toughness, and corrosion resistance properties.

14. A method of producing an aluminum product having high formability, high fracture toughness, high strength and improved corrosion resistance, the method comprising:

(a) providing stock including an aluminum base alloy consisting essentially of about 0.7 to 1.0 wt. % silicon, not more than about 0.3 wt. % iron, not more than about 0.5 wt. % copper, about 0.8 to 1.1 wt. % magnesium, about 0.3 to 0.4 wt. % manganese, and about 0.5 to 0.8 wt. % zinc, the remainder substantially aluminum, incidental elements and impurities;

(b) homogenizing the stock at a temperature ranging from about 950° to 1050° F. for a time period ranging from about 2 to 20 hours;

(c) hot rolling at a temperature ranging from about 750° to 950° F.;

(d) solution heat treating at a temperature ranging from about 1000° to 1080° F. for a time period ranging from about 5 minutes to one hour;

(e) cooling by quenching at a rate of about 1000° F./second to a temperature of 100° F. or lower; and (f) artificially aging by reheating to a temperature ranging from about 300° to 400° F. for a time period ranging from about 2 to 20 hours to produce a T6 temper in the aluminum product.

15. An aircraft fuselage skin produced by the method of claim 14.

16. A product comprising an aluminum base alloy consisting essentially of about 0.6 to 1.4 wt. % silicon, not more than about 0.5 wt. % iron, not more than about 0.6 wt. % copper, about 0.6 to 1.2 wt. % magnesium, about 0.4 to 1.4 wt. % zinc, at least one element selected from the group consisting of about 0.2 to 0.8 wt. % manganese and about 0.05 to 0.3 wt. % chromium, the remainder substantially aluminum, incidental elements and impurities, the product having a ductility loss at least 5% less than a comparably treated alloy comprising approximately 0.88 wt % Cu, 0.05 wt % Zn, 0.75 wt % Si, 0.17 wt % Fe, 0.42 wt % Mn, 0.95 wt % Mg, 0.08 wt % Ti and <0.01 wt % Cr.

17. The product of claim 16 wherein the alloy comprises about 0.7 to 1.0 wt. % silicon, not more than about 0.3 wt. % iron, not more than 0.5 wt. % copper, about 0.8 to 1.1 wt. % magnesium, and about 0.5 to 0.8 wt. % zinc.

18. The product of claim 16 wherein the alloy comprises about 0.3 to 0.4 wt. % manganese.

19. The product of claim 16 wherein the alloy comprises about 0.1 to 0.2 wt. % chromium.

20. The product of claim 16 having at least 25% improvement over 6013 alloy in corrosion resistance properties, as evidenced by loss of ductility after exposure to a salt-containing environment.

21. An aluminum alloy, consisting essentially of a) between 0.6 and 1.4 wt. % Si;

b) between 0.6 and 1.2 wt. % Mg;

c) less than 0.5 wt. % Fe;

d) less than 0.6 wt. % Cu;

e) at least one element selected from the group consisting of Mn and Cr, the Mn level being between 0.2 to 0.8 wt. % and the Cr level being between 0.05 to 0.3 wt. %;

f) between 0.4 and 1.4 wt. % Zn;

wherein the stock has a ductility loss at least 5% less than a comparably treated alloy comprising approximately 0.88 wt % Cu, 0.05 wt % Zn, 0.75 wt % Si, 0.17 wt % Fe, 0.42 wt % Mn, 0.95 wt % Mg, 0.08 wt % Ti and <0.01 wt % Cr.

22. An aluminum alloy in accordance with claim 21 wherein the Cu level is between 0.25 and 0.5 wt. %, the Zn level is between 0.5 and 0.8 wt. %; the magnesium level is between 0.8 to 1.1 wt. %, and the silicon level is between 0.7 and 1.0 wt. %.

23. An aluminum alloy in accordance with claim 21 wherein the alloy has at least 5% improvement in ductility loss over a comparably treated 6013 alloy, the 6013 alloy comprising approximately 0.88 wt % Cu, 0.05 wt % Zn, 0.75 wt % Si, 0.17 wt % Fe, 0.42 wt % Mn, 0.95 wt % Mg, 0.08 wt % Ti and <0.01 wt % Cr.

24. An aluminum alloy in accordance with claim 22 wherein the alloy has at least 5% improvement in ductility loss over a comparably treated 6013 alloy, the 6013 alloy comprising approximately 0.88 wt % Cu, 0.05 wt % Zn, 0.75 wt % Si, 0.17 wt % Fe, 0.42 wt % Mn, 0.95 wt % Mg, 0.08 wt % Ti and <0.01 wt % Cr.

* * * * *